US005114134A

United States Patent [19]

Rasmussen et al.

[11] Patent Number: 5,114,134

[45] Date of Patent: May 19, 1992

[54] PAPER FEED ARRANGEMENT

[75] Inventors: Steve O. Rasmussen; Larry A. Jackson, both of Vancouver, Wash.

[73] Assignee: Hewlett-Packard Company, Palo Alto, Calif.

[21] Appl. No.: 735,210

[22] Filed: Jul. 24, 1991

Related U.S. Application Data

[63] Continuation of Ser. No. 454,661, Dec. 18, 1989, abandoned.

[51] Int. Cl.[5] ..... B65H 3/04

[52] U.S. Cl. ..... 271/34; 271/121

[58] Field of Search ..... 271/6, 34, 121, 4, 18, 271/109, 10

[56] References Cited

U.S. PATENT DOCUMENTS

| | | | |
|---|---|---|---|
| 1,058,314 | 4/1913 | Lynch | 271/34 |
| 3,035,834 | 3/1962 | Bottrell | 271/34 |
| 3,768,803 | 10/1973 | Stange | 271/34 |
| 3,966,189 | 6/1976 | Taylor et al. | 271/34 |
| 4,312,503 | 1/1982 | Saxinger et al. | 271/34 |
| 4,431,175 | 2/1984 | Smith | 271/34 |
| 4,475,732 | 10/1984 | Clausing et al. | 271/34 |
| 4,579,332 | 4/1986 | Larson | 271/121 |
| 4,662,536 | 5/1987 | Powers | 271/121 |

FOREIGN PATENT DOCUMENTS

| | | | |
|---|---|---|---|
| 0004838 | 1/1982 | Japan | 271/4 |
| 0097141 | 5/1985 | Japan | 271/34 |

*Primary Examiner*—H. Grant Skaggs

[57] ABSTRACT

An improved paper feed arrangement wherein a low vertical profile is attained through utilizing trained driven belts for picking paper from a hopper, and wherein picking reliability is enhanced both by the broad-expanse area contact offered by such belts, and by a unique coefficient to friction differential area downstream from a hopper wherein inadvertently plural picked paper sheets are easily separated.

6 Claims, 2 Drawing Sheets

PAPER FEED ARRANGEMENT

This application is a continuation of application Ser. No. 07/454,661, filed Dec. 18, 1989 for PAPER FEED ARRANGEMENT now abandoned.

TECHNICAL FIELD

This invention relates to a paper-feed arrangement for incorporation into the structure of a printer and the like. The term "paper" used herein in the specification and claims is intended to mean and embrace any functionally similar sheet-like printing medium.

BACKGROUND ART

While paper-handling (picking and feeding) mechanisms have been around for many years, the technology continues to "search" for improvements in various areas, two of which include achieving greater and greater compactness, and higher and higher paper-pick/feed (single sheet at a time) reliability.

DISCLOSURE OF THE INVENTION

Accordingly, a general and important object of the present invention is to provide a novel paper-feed arrangement which addresses these two issues in ways which offer some significant advances.

According to a preferred embodiment of the invention, the proposed paper-feed arrangement includes a power-driven, low-profile paper-pick belt structure which is trained over the discharge zone in a paper-storage hopper for broad-expanse picking contact with the top sheet of paper in the hopper. Low-profile training of such a belt structure leads to an overall "vertical" depth, from the upper run of the belt structure to the base of the hopper, which is significantly less than that achieved in prior art arrangements where relatively high-profile pick roller structure is employed overlying the discharge end of a hopper. Broad-expanse, essentially quadrilinear, facial contact with a sheet of paper enhances picking reliability.

Further included, according to the preferred embodiment of the invention, in a region downstream from the hopper's discharge end, is an expanse of frictioning material, such as cork, which faces a run in the overlying belt structure. The materials chosen for the belt structure (plural belts) and for the frictioning expanse are such that the coefficient of friction expected between the belt and paper exceeds that expected between paper and the frictioning expanse, with the latter coefficient of friction exceeding that expected between two contacting sheets of paper. A consequence of this construction is that what might be thought of as a differentiated friction separation zone exists immediately downstream from the discharge end of a hopper, wherein, should more than one sheet of paper be picked initially from the hopper, a separation will occur, with the result that only the top sheet will actually travel into the downstream intended paper path.

These and other objects and advantages that are attained by the invention will become more fully apparent as the description which now follows is read in conjunction with the accompanying drawings.

DETAILED DESCRIPTION AND BEST MODE FOR CARRYING OUT THE INVENTION

Figure 1:
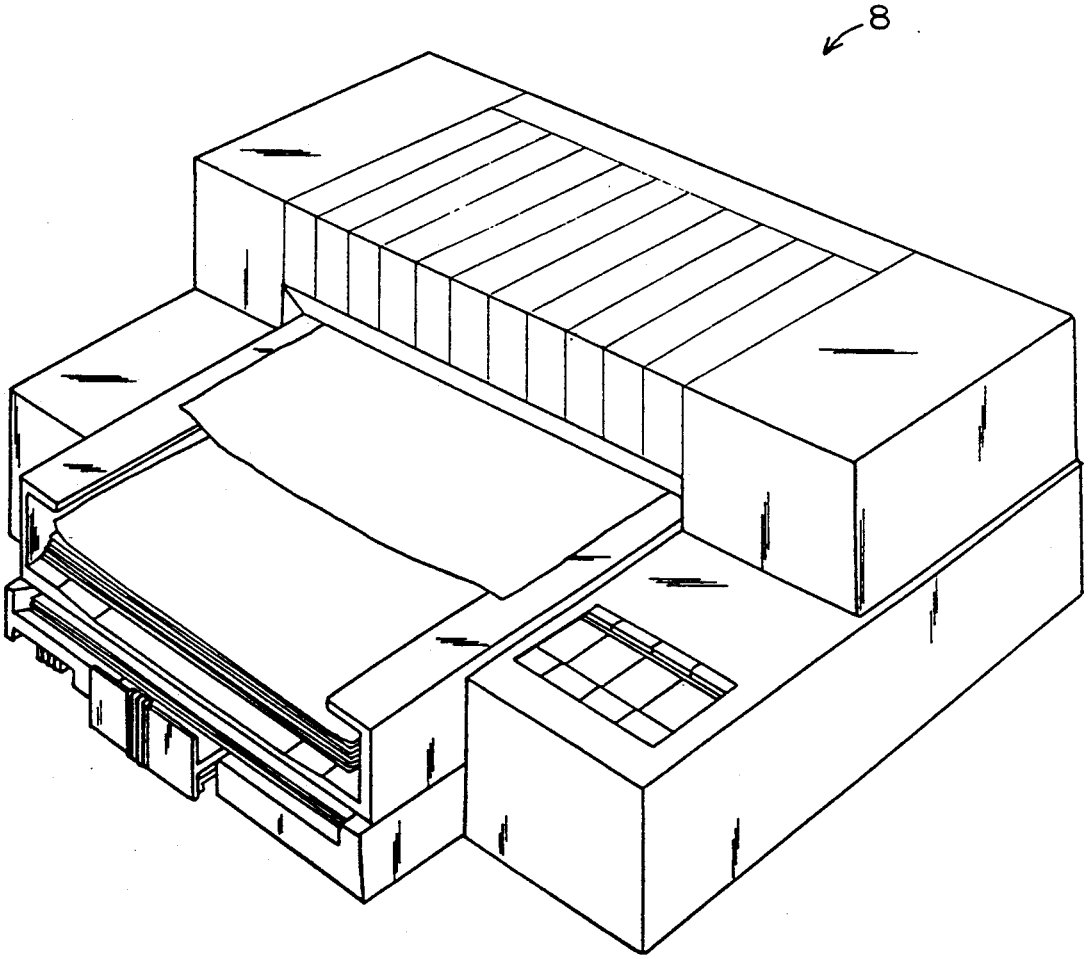
FIG. 1 is a somewhat simplified perspective view of an otherwise conventional computer-driven printer, such as an ink-jet printer, which incorporates a paper-feed arrangement constructed in accordance with the present invention.

FIG. 1 is included herein to provide an illustration of a typical setting wherein the arrangement proposed by the present invention has particular utility. In particular, this perspective view illustrates a conventional ink-jet, computer-driven printer 8 in which, as will be explained, the components of the present invention are incorporated.

Figure 2:
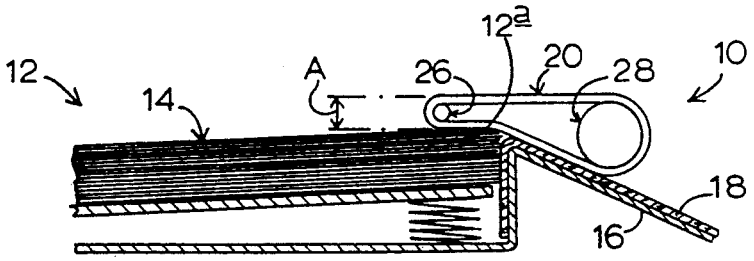
FIG. 2 is a simplified side section illustrating the details of the proposed paper-feed arrangement.
Figure 3:
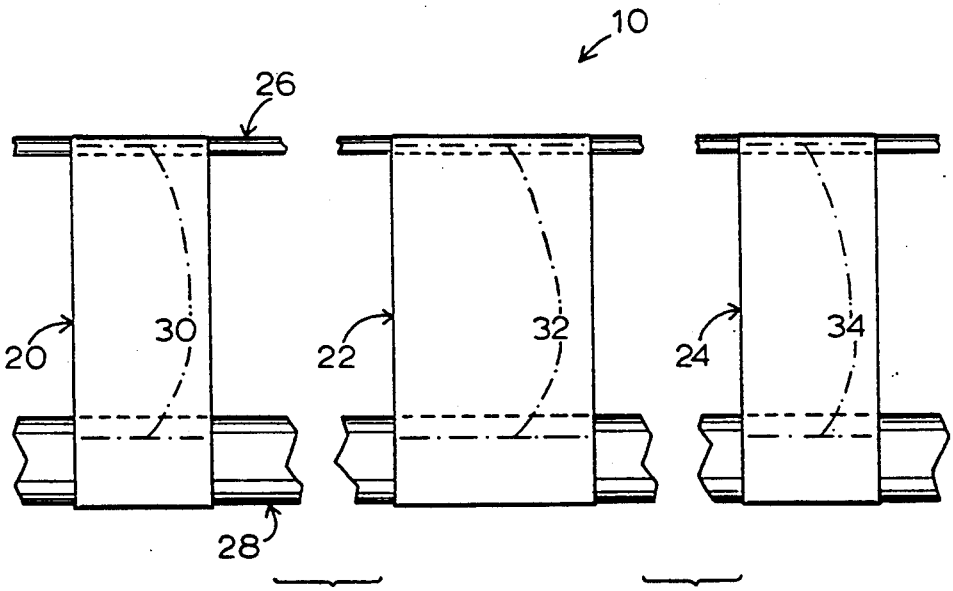
FIG. 3 is a fragmentary, simplified, top plan view further illustrating the arrangement of FIG. 2, and highlighting regions where broad-expanse paper contact occurs during operation of the arrangement.

Turning attention now, then, to FIGS. 2 and 3, illustrated generally at 10 is a paper-feed arrangement incorporated in printer 8, and constructed in accordance with the present invention. Included are a paper-storage hopper structure, or hopper, 12 (FIG. 2) including a discharge zone shown generally at 12*a*. Hopper 12 and its discharge zone are, essentially, conventional in construction. Shown stored as a stack in hopper 12 is a collection of sheets of paper 14 ready to be picked and fed for printing in the printer.

Immediately downstream from discharge zone 12*a* is a ramp structure 16 on the upper surface of which is suitably attached an expanse of cork 18, which is also referred to herein as frictioning means.

Overlying the organization so far described are three, laterally distributed, power-driven belts 20, 22, 24 which are also referred to herein collectively as broad-expanse, power-driven, traveling pick means. As can be seen particularly in FIG. 2 the left ends of the belts in this figure are trained in low-profile reverse bends over a rotatably mounted, elongated idler 26. This idler extends over discharge zone 12*a* at a location whereby a substantial under-facial expanse of each belt directly overlies and contacts the top sheet of paper stored in hopper 12. In the embodiment now being described, the vertical distance, shown at A in FIG. 2, between the top of each belt and the top of paper stacked in the hopper is approximately ⅜-inches.

Driving the belts during a picking/feeding operation is an elongate drive roller 28 over which the belts are likewise trained, which drive roller. Closely overlies ramp structure 16 some distance downstream from discharge zone 12*a*. This drive roller is positioned in such a manner that the undersides of runs of the belts extending from the base of the drive roller directly overlie and tend to contact the top surface of cork expanse 18. This region is referred to herein as a separation zone.

From the description which has been given so far, it should be readily apparent that the proposed belt pick-/feed approach results in substantial, generally quadralinear area-contact engagement with paper. In FIG. 3, underlying each of the belts in dash-dot lines, there are indications given at 30, 32, 34 of the contact areas provided. This feature which is offered by the use of belts is very distinct from prior art approaches where power-driven pick rollers typically offer extremely low-area line contact with paper.

With, and looking again just at FIG. 2, the drive roller and idler configured and relatively sized as shown it should be apparent that the overall height of the entire structure including the drive rollers and the hopper structure can be held to a minimum. And this, of course, is considered to be an important advantage. For example, reducing the height referred to allows for the offering of a very compact printer structure wherein two paper storage hoppers for handling different sizes of paper can be employed. Alternatively, other elements may be employed with a single hopper or the printer may simply be shorter.

According to another important feature of the invention, the material chosen for the belts, typically natural rubber, and that, typically cork, chosen for the frictioning expanses which underlie the belts where they extend over the ramp structure, have been chosen to provide a special differentiated coefficient of friction situation which further leads to enhanced picking and feeding reliability (one sheet at a time).

Figure 4:
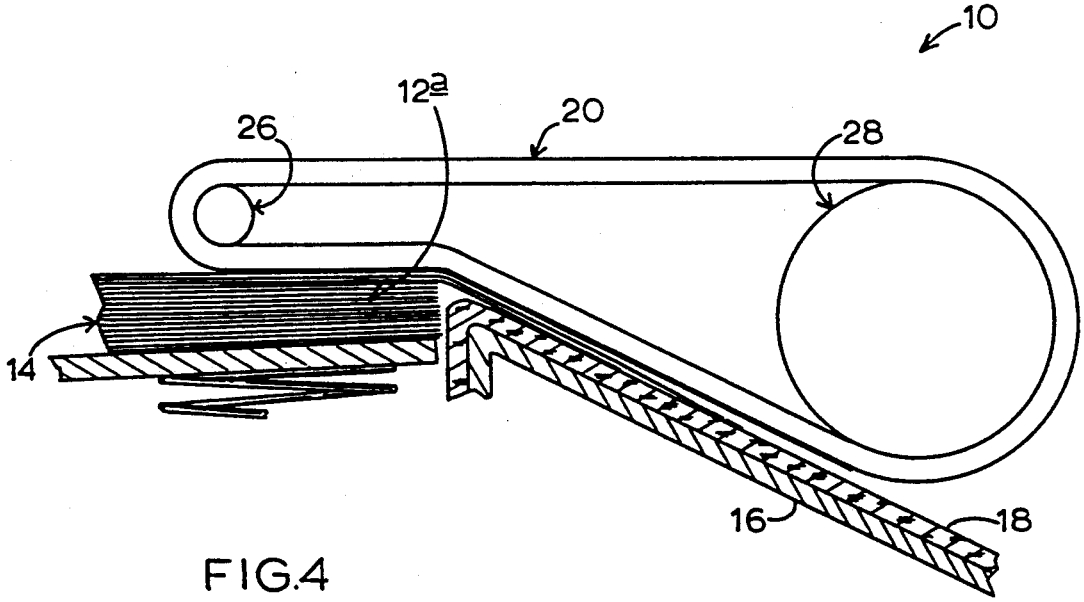
FIG. 4 takes, essentially, the same point of view as FIG. 2, and illustrates how, according to the invention, several papers (three) picked simultaneously are separated in a separation zone located downstream from where initial picking takes place. In this figure, the separation zone is artificially expanded in order to clarify what happens to paper in the zone.

Turning attention to FIG. 4, there is illustrated a situation where, with operation of the belts, three sheets of paper have initially been picked from the stack in the hopper. The differentiated coefficient of friction consideration just mentioned is one wherein the expected coefficient of friction between the contacting faces of two sheets of paper is less than that expected between the face of a sheet of paper and cork expanses 18, with the latter being less than that coefficient of friction which is expected between the belts and the face of a sheet of paper. The paper/paper coefficient of friction is also referred to herein as PP, that between paper and cork expanses 18 as PF, and that between the belts and paper as PB.

What occurs as a consequence of this differentiated coefficient of friction situation is that where, as is shown in FIG. 4, plural sheets are picked, the sheets will tend to separate easily in the separation zone immediately downstream from discharge zone 12*a*. In the specific case illustrated, the bottom one of the three picked sheets becomes initially caught by the cork to allow the intermediate-picked sheet to slide over and then become caught, with the desired top sheet continuing to be fed appropriately by the belts.

It should thus be apparent how the two issues of compactness and pick/feed (single sheet at a time) reliability are successfully addressed by the arrangement proposed by the present invention.

INDUSTRIAL APPLICABILITY

The above-described invention is applicable to any situation where paper is being picked and fed into a device such as a printer. While a preferred embodiment of the latter has, accordingly, been shown and described herein, it is appreciated that variations and modifications may be made without departing from the spirit of the invention.

What is claimed is:

1. For incorporation in a printer and the like, a low-profile, enhanced-reliability paper-feed arrangement comprising:

paper-storage hopper structure including a discharge zone enabling picking of the top sheet of paper in a stack in the hopper, and a broad-expanse, power driven, traveling pick belt disposed adjacent said discharge zone trained, in two reverse bends, around a drive roller having one diameter displaced laterally downstream from said zone and an idler roller having another diameter which is a small fraction of said one diameter disposed over the zone operable, with paper stored in said hopper structure to pick such paper through the action of generally quadrilinear, broad-area facial contact with the same, said pick belt, where it is trained over said drive roller, vertically spanning an extent which straddles the plane containing such a top sheet, and where it is trained over said idler roller, spanning a vertical extent which is a small fraction of said first-mentioned extent.

2. The arrangement of claim 1 which further comprises a stationary expanse of frictioning means facing a run in said belt downstream from said discharge zone, adapted for facial contact with a sheet of paper picked by the belt.

3. The arrangement of claim 2 which is designed in such manner that the nominal coefficients of friction expected to exist between paper and belt (PB), between paper and paper (PP), and between paper and frictioning means (PF) are different, with PF exceeding PP, and PB exceeding PF.

4. For incorporation in a printer and the like, a low-profile, enhanced-reliability paper-feed arrangement comprising:

paper-storage hopper structure including a discharge zone enabling picking of the top sheet of paper in a stack in the hopper, and a broad-expanse, power driven, traveling pick belt disposed adjacent said discharge zone trained, in two reverse bends, around a drive roller having one diameter displaced laterally downstream from said zone and an idler roller having another diameter which is less than about 50-percent of said one diameter disposed over the zone operable, with paper stored in said hopper structure, to pick such paper through the action of generally quadrilinear, broad-area facial contact with the same, said pick belt, where it is trained over said drive roller, vertically spanning an extent which straddles the plane containing such a top sheet, and where it is trained over said idler roller spanning a vertical extent which is less than about 50-percent of said first-mentioned extent.

5. The arrangement of claim 4 which further comprises a stationary expanse of frictioning means facing a run in said belt downstream from said discharge zone, adapted for facial contact with a sheet of paper picked by the belt.

6. The arrangement of claim 5 which is designed in such manner that the nominal coefficients of friction expected to exist between paper and belt (PB), between paper and paper (PP), and between paper and frictioning means (PF) are different, with PF exceeding PP, and PB exceeding PF.

* * * * *